US006768455B1

(12) United States Patent
Werntz et al.

(10) Patent No.: US 6,768,455 B1
(45) Date of Patent: Jul. 27, 2004

(54) CALIBRATION PROBE MOTION DETECTOR

(75) Inventors: Paul C. Werntz, Long Beach, CA (US); Sien-Chang C. Liu, Brea, CA (US); Lauriston Wah, Manhattan Beach, CA (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 10/442,496

(22) Filed: May 20, 2003

(51) Int. Cl.[7] ..... H01Q 3/22
(52) U.S. Cl. ..... 342/368; 342/174
(58) Field of Search ..... 342/165, 173, 342/174, 368, 369

(56) References Cited

U.S. PATENT DOCUMENTS 4,893,284 A * 1/1990 Magrane ..... 367/12
5,530,449 A * 6/1996 Wachs et al. ..... 342/174
6,636,173 B2 * 10/2003 Graham ..... 342/174

* cited by examiner

*Primary Examiner*—Dao Phan
(74) *Attorney, Agent, or Firm*—Shimokaji & Associates, P.C.

(57) ABSTRACT

A method for detecting calibration probe displacement for a phased array antenna includes steps of: creating a gold standard set of antenna element phases of the phased array antenna; determining a set of element phase sensitivities of the phased array antenna; measuring a set of antenna element phases relative to array displacement of the phased array antenna; and forming a set of equations using the gold standard set of antenna element phases, the set of element phase sensitivities, and the set of antenna element phases relative to array displacement. The set of equations has an array displacement vector x as unknown; and solving the set of equations for the array displacement vector x provides the location and orientation of the calibration probe displacement.

43 Claims, 4 Drawing Sheets

CALIBRATION PROBE MOTION DETECTOR

BACKGROUND OF THE INVENTION

The present invention generally relates to phased array antennas and, more particularly, to detection of calibration probe movements or displacements relative to a phased array antenna.

Phased array antennas have many applications in the fields of communications and remote sensing, and are widely used, for example, on spacecraft such as communications satellites and remote sensing satellites. A phased array antenna typically includes a number of antenna elements arranged in a planar array configuration. The amplitudes and phases of the electromagnetic radiation of the antenna elements may be coordinated as a specific distribution of amplitudes and phases among the elements to achieve antenna performance characteristics for the phased array antenna as a whole. For example, the antenna radiation can be formed into a beam, the beam pattern can be adjusted, the beam pointing direction can be adjusted or even rapidly scanned, and sidelobe level and shape can be controlled.

The performance of phased array antennas, for example, beam pointing and sidelobe level, can be adversely affected by element amplitude and phase errors relative to the desired array amplitude and phase distribution. Such amplitude and phase errors can be caused by variation in the array electronic components—such as low noise amplifiers, solid state power amplifiers, mixers, phase shifters, and variable attenuators—over the lifetime of the satellite. To detect and correct for electronic component performance changes, phased array antennas typically include a calibration system with an external source (for receive arrays) or receiver (for transmit arrays) for which the array antenna has a signature response. The calibration system can greatly improve the performance and reliability of the phased array antenna.

The calibration system may use a set of probes that are embedded in the array. Alternatively, the calibration system may more simply use a single calibration probe that is separated a distance from the array. For satellite systems a single calibration probe may be preferable because it is generally lighter and less complicated than a set of embedded calibration probes. The calibration probe may be on the ground—for ground calibration—or may be located on the satellite for on-board calibration. In either case, the geometric relationship between the calibration probe and the array is crucial to the performance of the calibration system.

On-board calibration has several advantages over ground calibration. For example, the larger signal-to-noise ratio using on-board calibration leads to faster, more accurate measurements. Also, for example, using on-board calibration there is no need to compensate for doppler frequency shifts caused by motion between the satellite and points on the earth, and there are no atmospheric effects. A problem, however, with on-board calibration is that launch loads, i.e., forces due to spacecraft accelerations during launching, and thermal effects—such as material distortions, i.e., expanding/contracting, due to changes in temperature or temperature gradients—can affect the structure that holds the array and calibration probe and cause changes in the geometric relationship between the calibration probe and the array. Changes in the geometry between the calibration probe and the array can cause errors in the calibration measurement resulting in antenna beam pointing errors. Beam pointing errors can be corrected, however, if the change in geometry is known.

As can be seen, there is a need for detecting changes in the geometric relationship between the calibration probe and the array for phased array antennas. Moreover, there is a need for detecting changes in the geometric relationship between the calibration probe and the array for phased array antennas for on-board calibration of phased array antennas on spacecraft such as communication and remote sensing satellites.

SUMMARY OF THE INVENTION

In one aspect of the present invention, a method for detecting calibration probe displacement for a phased array antenna includes steps of: creating a gold standard set of antenna element phases of the phased array antenna; determining a set of element phase sensitivities of the phased array antenna; measuring a set of antenna element phases relative to array displacement of the phased array antenna; and forming a set of equations using the gold standard set of antenna element phases, the set of element phase sensitivities, and the set of antenna element phases relative to array displacement. The set of equations has an array displacement vector x as unknown; and solving the set of equations for the array displacement vector x provides the location and orientation of the calibration probe displacement.

In another aspect of the present invention, a method for detecting calibration probe displacement relative to a phased array antenna, includes a step of creating a gold standard set of antenna element phases including measuring a gold standard antenna element phase of several array elements of the phased array antenna with a calibration probe at a nominal position. The method also includes a step of determining a set of element phase sensitivities of the phased array antenna, including: measuring baseline antenna element phases for several array elements with a calibration probe at a nominal position; displacing the calibration probe a known amount and direction to a first displaced position; and measuring displaced antenna element phases for several array elements with the calibration probe at the first displaced position. The method also includes a step of measuring a set of antenna element phases relative to array displacement including measuring antenna element phases relative to array displacement of the array elements of the phased array antenna with the calibration probe at a second displaced position. The method further includes steps of forming a set of equations using the gold standard set of antenna element phases, the set of element phase sensitivities, and the set of antenna element phases relative to array displacement, the set of equations having an array displacement vector x as unknown; and solving the set of equations for the array displacement vector x.

In still another aspect of the present invention, a method for in-flight detection of relative displacement between a calibration probe on-board a spacecraft and a phased array antenna on-board the spacecraft, includes a step of creating a gold standard set of antenna element phases including measuring a gold standard antenna element phase of several array elements of the phased array antenna with a calibration probe at a nominal position under controlled conditions.

The method also includes a step of determining a set of element phase sensitivities of the phased array antenna under controlled conditions, including: measuring a baseline antenna element phase for several array elements with a calibration probe at a nominal position; displacing the calibration probe a known amount and direction to a first displaced position; measuring a first displaced antenna element phase for several array elements with the calibration probe at the first displaced position; subtracting the baseline antenna element phase from the first displaced antenna element phase and dividing by the known amount; rotating the calibration probe a known angle and direction to a second displaced position; measuring a second displaced antenna element phase for several array elements with the calibration probe at the second displaced position; subtracting the baseline antenna element phase from the second displaced antenna element phase and dividing by the known angle.

The method also includes a step of measuring a set of antenna element phases relative to array displacement by using a calibration system while the spacecraft is in flight including measuring antenna element phases relative to array displacement of the array elements of the phased array antenna with the calibration probe at a third displaced position.

The method further includes steps of forming a set of equations using the gold standard set of antenna element phases, the set of element phase sensitivities, and the set of antenna element phases relative to array displacement, the set of equations having an array displacement vector x as unknown, wherein the array displacement vector x determines a location and orientation of the third displaced position; and solving the set of equations for the array displacement vector x.

In yet another aspect of the present invention, a method for in-flight detection of relative displacement between a calibration probe on-board a spacecraft and a phased array antenna on-board the spacecraft includes a step of creating a gold standard set of antenna element phases including measuring a gold standard antenna element phase Gp1 of an array element of the phased array antenna with a calibration probe at a nominal position under controlled conditions.

The method also includes a step of determining under controlled conditions a set of element phase sensitivities for the array element, including a Δx_sensitivity1 , a Δy_sensitivity1 , a Δz_sensitivity1 , an rx_sensitivity1 , and an ry_sensitivity1 , including: measuring a baseline antenna element phase for several array elements with a calibration probe at a nominal position; displacing the calibration probe a known amount and direction to a first displaced position; measuring a first displaced antenna element phase for several array elements with the calibration probe at the first displaced position; subtracting the baseline antenna element phase from the first displaced antenna element phase and dividing by the known amount; rotating the calibration probe a known angle and direction to a second displaced position; measuring a second displaced antenna element phase for several array elements with the calibration probe at the second displaced position; subtracting the baseline antenna element phase from the second displaced antenna element phase and dividing by the known angle.

The method also includes a step of measuring a set of antenna element phases relative to array displacement by using a calibration system while the spacecraft is in flight including measuring an antenna element phase Ep1 relative to array displacement of the array element of the phased array antenna with the calibration probe at a third displaced position.

The method also includes a step of forming a set of equations using the gold standard set of antenna element phases, the set of element phase sensitivities, and the set of antenna element phases relative to array displacement, the set of equations having an array displacement vector x=(Δx, Δy, Δz, rx, ry) as unknown, where the array displacement vector x determines a location and orientation of the third displaced position, and the set of equations includes the equation:

$$(\Delta x_\text{sensitivity}\mathbf{1}\cdot\Delta x)+(\Delta y_\text{sensitivity}\mathbf{1}\cdot\Delta y)+(\Delta z_\text{sensitivity}\mathbf{1}\cdot\Delta z)+(rx_\text{sensitivity}\mathbf{1}\cdot rx)+(ry_\text{sensitivity}\mathbf{1}\cdot ry)=(\text{Ep}\mathbf{1}-\text{Gp}\mathbf{1}).$$

The method further includes steps of ordering the set of equations and writing the set of equations in matrix notation as: Ax=(Ep−Gp); and solving the set of equations for the array displacement vector x.

These and other features, aspects and advantages of the present invention will become better understood with reference to the following drawings, description and claims.

DETAILED DESCRIPTION OF THE INVENTION

The following detailed description is of the best currently contemplated modes of carrying out the invention. The description is not to be taken in a limiting sense, but is made merely for the purpose of illustrating the general principles of the invention, since the scope of the invention is best defined by the appended claims.

Broadly, the present invention provides detection of changes in the geometry between a calibration probe and a phased array antenna. The present invention may be used wherever phased array antennas are used and, in particular, finds use in the fields of communications and remote sensing. An embodiment of the present invention is especially useful for on-board calibration of phased array antennas on commercial spacecraft, for example, communications satellites and remote sensing satellites. One embodiment of the present invention may be used with a digital beam forming system—such as those used by Boeing Thuraya® or ICO® satellites—or with an analog beam forming network—such as those used by Boeing Advanced EHF®, Spaceway®, or Wideband Gap Filler® satellites.

Figure 1:
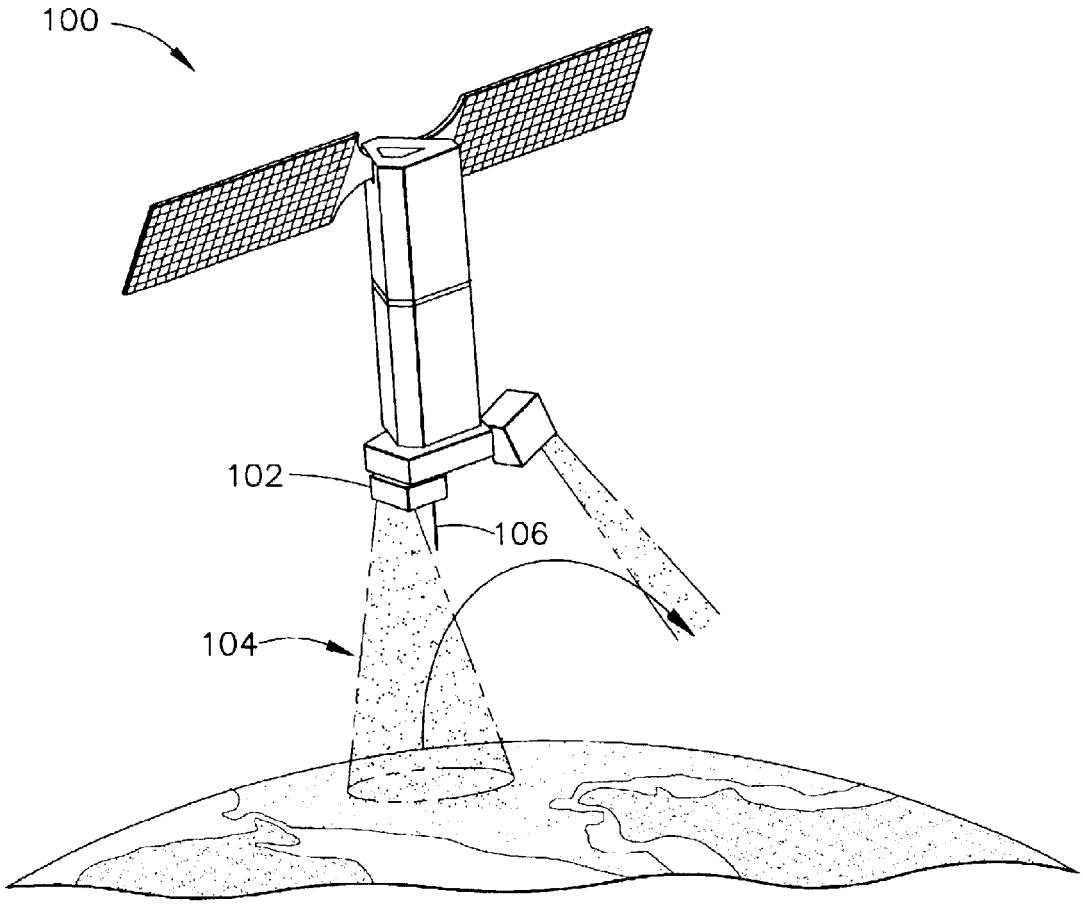
FIG. 1 is a perspective view of a satellite having an antenna array with a calibration probe, according to an embodiment of the present invention.

For example, FIG. 1 shows a satellite spacecraft 100 having a phased array antenna 102 that may direct an antenna beam 104 toward the ground, for example. Spacecraft 100 may employ a calibration system, as known in the art, capable of measuring the phase of electromagnetic radiation for elements of phased array antenna 102 for calibrating phased array antenna 102. The calibration system may include components on the ground, for example, as well as on spacecraft 100. For example, measurements made by the calibration system on spacecraft 100 may be transmitted to the ground for processing by a computer and results, for example, in the form of an updated calibration table, may be transmitted back to spacecraft 100 for use on spacecraft 100 by the calibration system. Spacecraft 100 may also include a calibration probe 106 which may be used by the calibration system for on-board calibration of phased array antenna 102. The calibration system may employ an embodiment of the present invention while spacecraft 100 is in flight, for example, for on-board detection of displacements and rotations of calibration probe 106, which may also be referred to as "movement" or "motion" of the calibration probe.

Unlike the prior art, one embodiment of the present invention does not require the phased array antenna being calibrated to produce any special beams for calibration. In one embodiment, the present invention requires only measurement of phase information from a subset of elements in the phased array, i.e., the calibration system need only be able to measure the phase of the elements in the array. In one embodiment, the present invention provides a system for detecting and quantifying changes in geometry between a calibration antenna, i.e., calibration probe, and an array antenna, which may enable array antenna beam pointing errors to be reduced.

Figure 2:
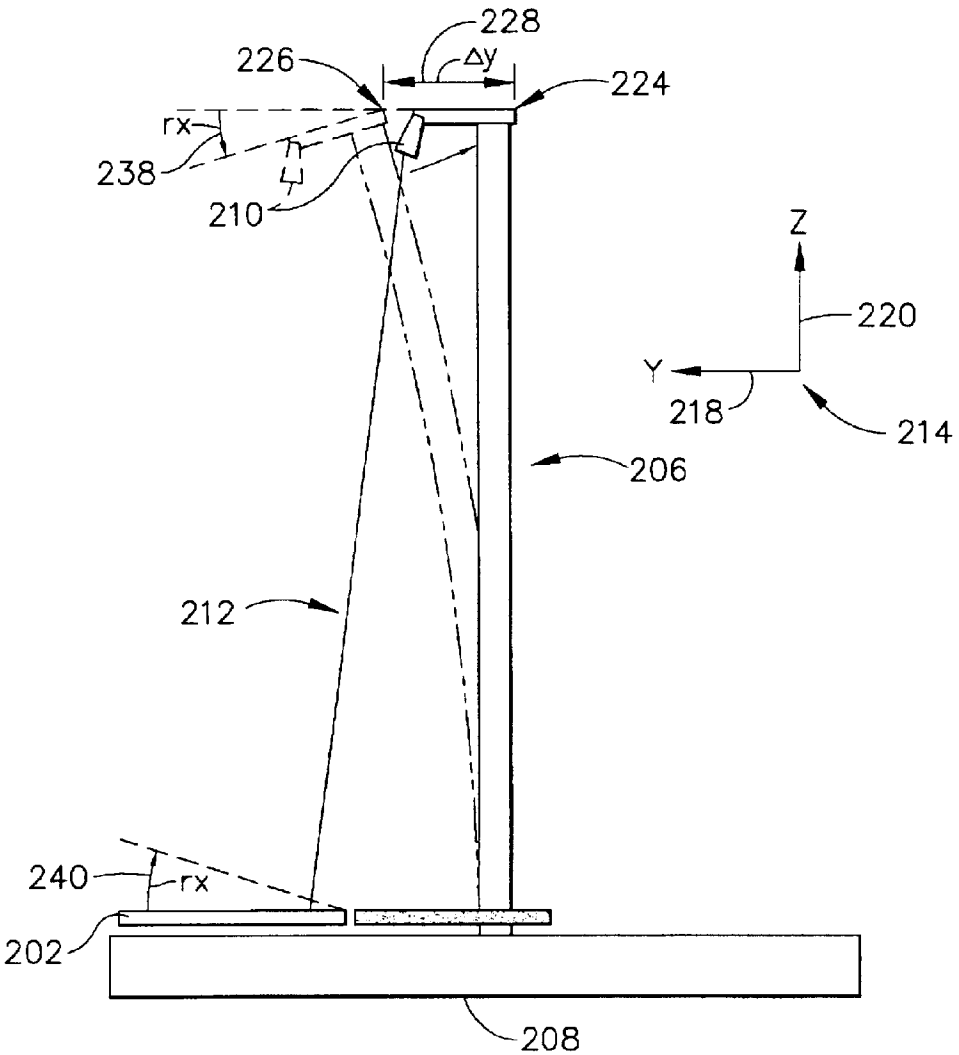
FIG. 2 is a side view of an antenna array with a calibration probe, according to an embodiment of the present invention.
Figure 3:
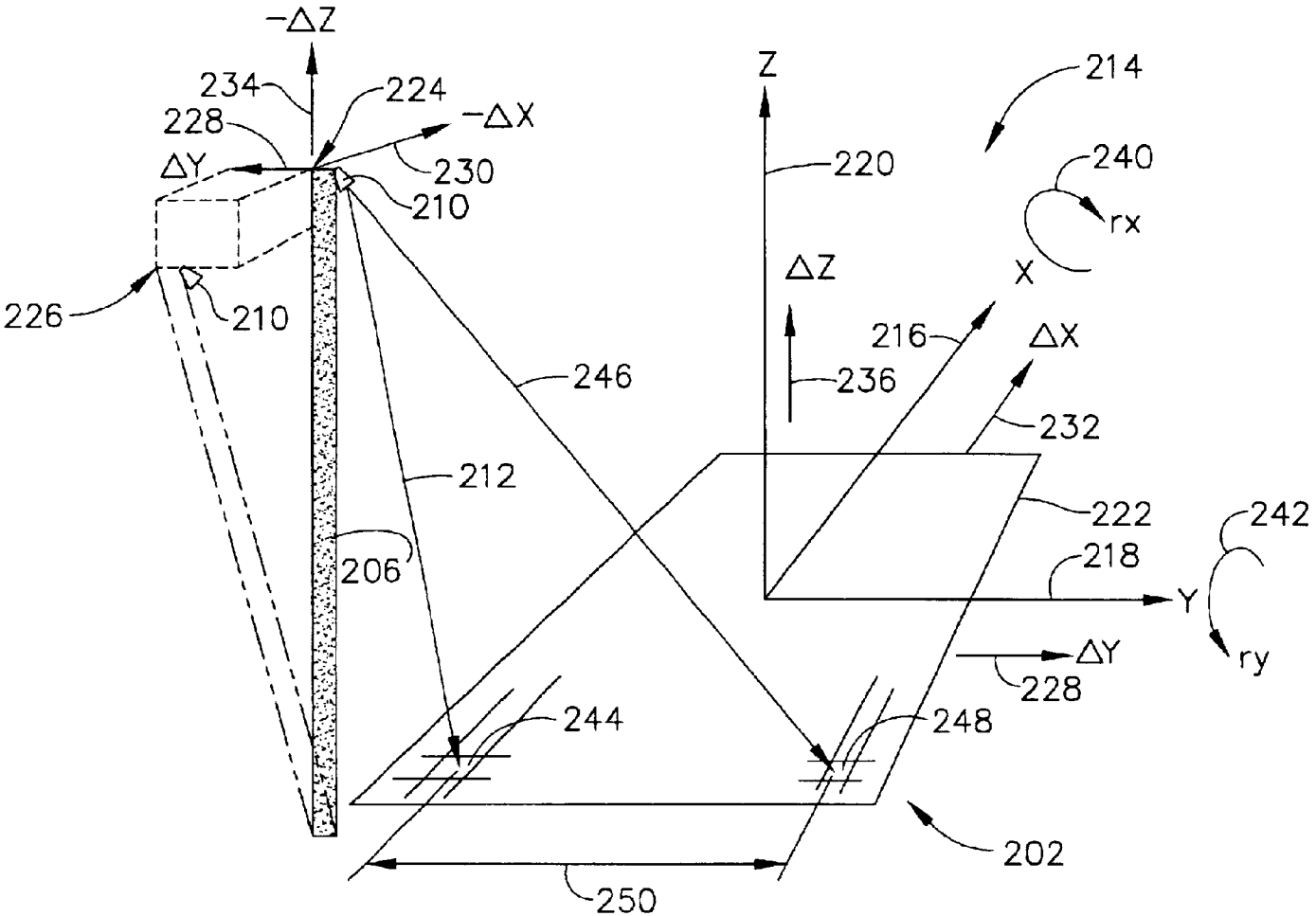
FIG. 3 is a perspective diagram of an antenna array with a calibration probe as shown in FIG. 2 and frames of reference for detecting calibration probe movement, according to one embodiment of the present invention.

Referring now to FIGS. 2 and 3, FIG. 2 shows calibration probe (or probe antenna) 210, which may be supported on a spacecraft—such as satellite 100—by a calibration support boom 206 or a portion of the spacecraft structure, spacecraft bus 208. Spacecraft bus 208 may also support a phased array antenna 202. The calibration probe (i.e., probe antenna) 210 may provide measurement beams—such as measurement beam 212—between calibration probe 210 and elements of phased array antenna 202, as known in the art. For example, if phased array antenna 202 is a receive antenna, measurement beam 212 may be transmitted by calibration probe 210, and if phased array antenna 202 is a transmit antenna, measurement beam 212 may be received by calibration probe 210. The elements of phased array antenna 202 may typically be arranged in a plane that determines a frame of reference—such as frame of reference 214—having an X-axis 216 (perpendicular to the page in FIG. 2 but shown in FIG. 3), a Y-axis 218 and a Z-axis 220 in which the X, Y, and Z axes are mutually perpendicular and in which the X-axis 216 and the Y-axis 218 are mutually perpendicular and lie within a plane 222 (shown in FIG. 3) parallel to that of the elements of phased array antenna 202.

Calibration support boom 206, and more particularly calibration probe 210, is shown in FIGS. 2 and 3 at a nominal position 224. Nominal position 224 may be the position at which phased array antenna 202 is initially calibrated, for example, during fabrication or testing of phased array antenna 202 "at the factory". Nominal position 224 may be considered to be the original position of calibration probe 210 relative to phased array antenna 202, at thermal equilibrium and before any forces or accelerations have acted on phased array antenna 202 and calibration support boom 206. Calibration support boom 206 is also shown by phantom lines in FIGS. 2 and 3 at a displaced position 226 relative to phased array antenna 202. Calibration probe 210 could be displaced to displaced position 226, for example, by forces acting on calibration support boom 206 and calibration probe 210 due to acceleration of spacecraft bus 208 or, for example, by uneven thermal expansion of the material of calibration support boom 206 due to one side of calibration support boom 206 being in direct sunlight while the opposite side is in shadow.

As seen in FIG. 2, calibration support boom 206, and more particularly calibration probe 210, may be displaced in the Y direction, i.e., the direction of Y-axis 218 by an amount Δy 228. The displacement Δy 228 is also shown in FIG. 3 at the end of calibration support boom 206 and relative to frame of reference 214. Note that the same displacement Δy 228 is in the opposite direction at the end of calibration support boom 206 from its direction relative to frame of reference 214 at phased array 202 because the motions, i.e., displacements, of calibration probe 210 and phased array 202 are expressed relative to each other. Equivalently, the negative, or opposite, of a displacement at the end of calibration support boom 206 is in the same direction as the same displacement relative to frame of reference 214 at phased array 202. For example, negative displacement (−Δx) 230 at the end of calibration support boom 206 is shown in FIG. 3 in the same direction as (positive) displacement Δx 232, which is in the X direction, i.e., the direction of X-axis 216. Also for example, negative displacement (−Δz) 234 at the end of calibration support boom 206 is shown in FIG. 3 in the same direction as (positive) displacement Δz 236, which is in the Z direction, i.e., the direction of Z-axis 220. Thus, as seen in FIG. 3, calibration support boom 206, and more particularly calibration probe 210, may be displaced from nominal position 224 to displaced position 226, by displacement Δx 232 in the X direction, displacement Δy 228 in the Y direction, and displacement Δz 236 in the Z direction. The location of displaced position 226 relative to nominal position 224 may thus be determined from the displacements Δx 232, Δy 228, and Δz 236. The displacements Δx 232, Δy 228, and Δz 236 may all be zero, in which case displaced position 226 is identical to nominal position 224 but, in general, the two positions are not assumed to coincide.

Also as seen in FIG. 2, calibration support boom 206, and more particularly calibration probe 210, may be rotated about X-axis 216 by an angle rx 238. Note that the rotation rx 238 is in the opposite direction at the calibration probe 210 from the direction of the equivalent rotation rx 240 at phased array 202 (relative to frame of reference 214) because the motions, i.e., rotations, of calibration probe 210 and phased array 202 are expressed relative to each other. So, for example, rotation rx 238 is shown in FIG. 2 as a counterclockwise rotation at the calibration probe 210, while the equivalent rotation rx 240 of phased array 202 is shown in FIG. 2 as a clockwise rotation. The rotation rx 240, about X-axis 216, of calibration probe 210 relative to phased array antenna 202 is also shown in FIG. 3 relative to frame of reference 214. Similarly, rotation ry 242, about Y-axis 218, of calibration probe 210 relative to phased array antenna 202 is shown in FIG. 3 relative to frame of reference 214.

Thus, relative motion, i.e., movement or displacement, between calibration probe 210 and phased array 202 may be quantified by the displacements Δx 232, Δy 228, Δz 236, and the rotations rx 240 and ry 242 relative to reference frame 214 oriented to plane 222 of phased array antenna 202, as shown in FIG. 3. Displacements Δx 232, Δy 228, Δz 236, and rotations rx 240 and ry 242 may be formed into an array displacement vector x, denoted as: x=(Δx, Δy, Δz, rx, ry). The location and orientation of displaced position 226 relative to nominal position 224 may thus be determined from the displacements Δx 232, Δy 228, Δz 236 and the rotations rx 240 and ry 242, i.e., the array displacement vector (Δx, Δy, Δz, rx, ry). The displacements Δx 232, Δy 228, and Δz 236 may all be zero, in which case displaced position 226 is identical to nominal position 224 but, in general, the two positions are not assumed to coincide. The rotations rx 240 and ry 242 may be zero, in which case displaced position 226 has the same angular orientation as nominal position 224 but, in general, the orientations of the two positions are not assumed to be parallel. The displacement of displaced position 226 relative to nominal position 224 when rotations rx 240 and ry 242 are zero may be referred to as translation of displaced position 226 from nominal position 224 and may also be referred to as array translation. The displacement of displaced position 226 relative to nominal position 224 when either or both of rotations rx 240 or ry 242 are non-zero may be referred to as array rotation.

In order to detect, i.e., quantify, relative motion between the calibration probe 210 and phased array antenna 202, a calibration system, as known in the art and not shown in the figures, may be used to measure a set of phases for a set of elements of phased array antenna 202. For example, a first antenna element phase can be measured using measurement beam 212 between calibration probe 210 and array element 244. The phase can be measured in degrees or radians so that, for example, an antenna element phase of 30 degrees for array element 244 indicates that the phase of the signal propagated on measurement beam 212 differs by 30 degrees from a known phase of zero established by the calibration system. As pointed out above, measurement beam 212 can be transmitted from calibration probe 210 to array element 244 in case phased array antenna 202 is a receive antenna, or measurement beam 212 can be transmitted from array element 244 to calibration probe 210 in case phased array antenna 202 is a transmit antenna. Continuing with the example, a second antenna element phase can be measured using measurement beam 246 between calibration probe 210 and array element 248. The first antenna element phase for array element 244 measured using measurement beam 212 and the second antenna element phase for array element 248 measured using measurement beam 246 may be included in a set of phase measurements for a set of array elements in which array element 244 and array element 248 are included and in which the first antenna element phase is that of array element 244 and the second antenna element phase is that of array element 248.

A phenomenon encountered using prior art calibration systems is that array translation (as defined above) may cause an apparent almost linear phase progression across phased array antenna 202 as seen by calibration probe 210. For example, referring to FIG. 3, the antenna element phase for array element 244 is different from that expected by a certain amount 100 1 (referred to as a "phase error") and the antenna element phase for array element 248 is different from that expected by a certain amount $\phi 2$, and the difference between phase errors $\phi 1$ and $\phi 2$ is (linearly) proportional to the distance 250 between array element 244 and array element 248. If the calibration system were to correct for this almost linear phase progression, the antenna beam—such as antenna beam 104—for phased array antenna 202 would be re-pointed in a different direction. Array translation, however, being a parallel movement of the array relative to the probe (as defined above) does not change the direction that the antenna beam of phased array antenna 202 points. Thus, array translation, if corrected for by the calibration system, introduces a beam pointing error by re-pointing the antenna beam in a different direction.

In addition, array rotation (as defined above) also may cause an apparent almost linear phase progression across phased array antenna 202 as seen by calibration probe 210. Array rotation, unlike array translation, does change the direction that antenna beam of phased array antenna 202 points. Thus, array rotation should be corrected for by the calibration system to re-point the antenna beam in a different direction to correct beam pointing error. Because both array translation and array rotation introduce almost linear phase errors, i.e., apparent almost linear phase progression across phased array antenna 202 as seen by calibration probe 210, there is no simple way to distinguish the phase errors caused by translation from those caused by rotation. If the displacement, i.e., both translation and rotation, of calibration probe 210 relative to phased array antenna 202 is known, i.e., has been detected, however, the phase errors can be separated according to translation versus rotation, enabling the calibration system to make a proper beam pointing correction.

Figure 4:
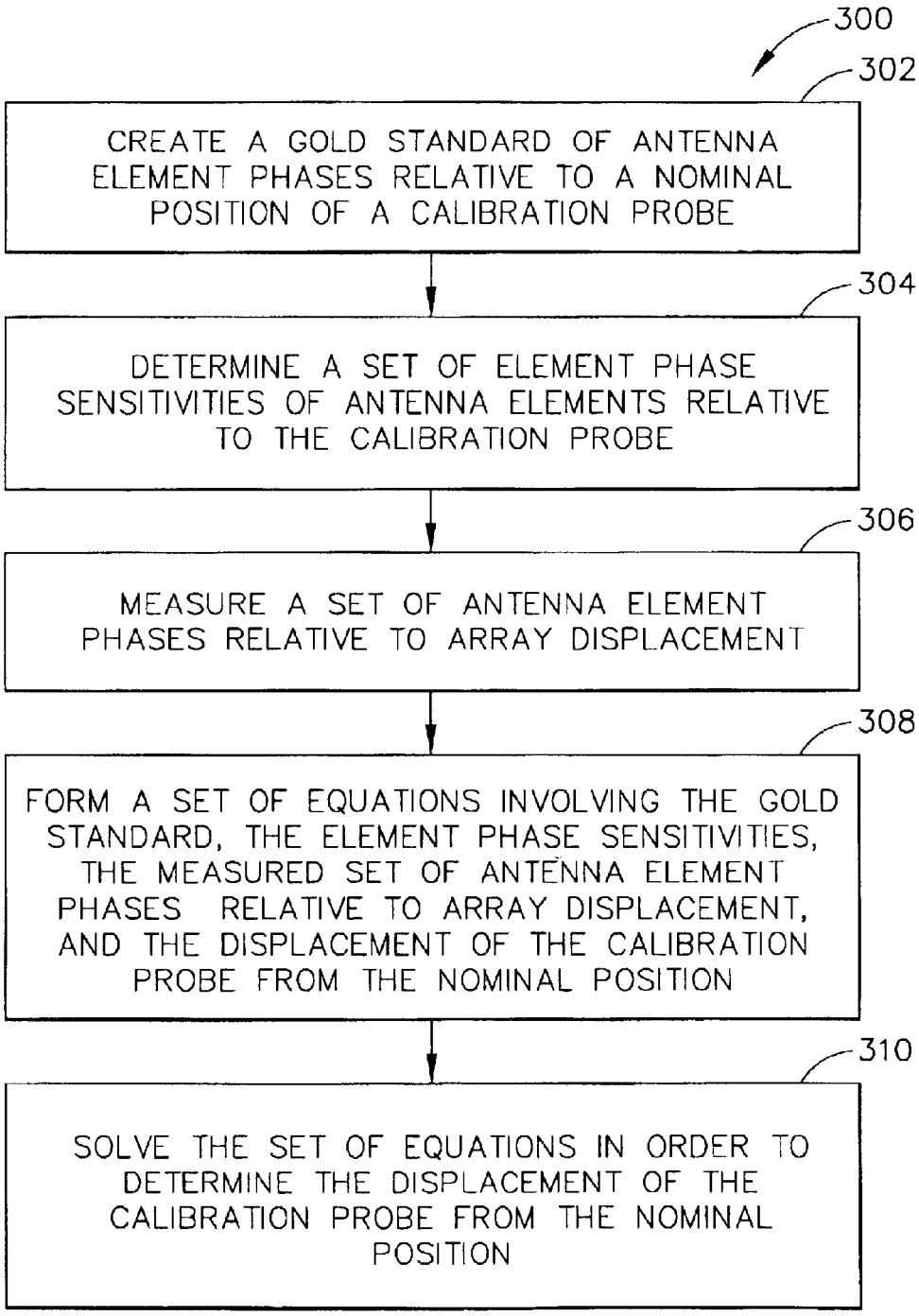
FIG. 4 is a flow chart illustrating a method for calibration probe motion detection, in accordance with an embodiment of the present invention.

Referring now to FIG. 4, an exemplary embodiment of a method 300 for detecting calibration probe displacement for a phased array antenna, such as phased array antenna 202 with calibration probe 210 as shown in FIGS. 2 and 3, is illustrated. Method 300 may be implemented, for example, using a prior art calibration system on a satellite or spacecraft—such as spacecraft 100, using a phased array antenna on the spacecraft—such as phased array antenna 102, using a calibration probe on the spacecraft—such as calibration probe 106, and using computers or electronic processors, which may be located both on spacecraft 100, for example, and on the ground and which may implement method 300 using software loaded in a memory in a computer processor on the ground or a processor on spacecraft 100 or both. Exemplary method 300 may include steps 302, 304, 306, 308, and 310, which conceptually delineate method 300 for purposes of conveniently illustrating method 300 according to one embodiment. Exemplary method 300 is illustrated with reference to FIGS. 2 and 3.

Method 300 may begin with step 302, in which a set of antenna element phases is created with calibration probe 210 at the nominal position 224 relative to phased array antenna 202. The set of antenna element phases for which calibration probe 210 is at nominal position 224 is referred to as the "gold standard". A gold standard antenna element phase may be determined for each antenna element of phased array antenna 202, i.e., for all elements of the array, or for only some subset of elements of the array, i.e., for some of the antenna elements of phased array antenna 202 but not all of them. For example, gold standard antenna element phases may be determined by using the calibration system to make a phase measurement for each array element such as array element 244 using calibration probe 210 and measurement beam 212—as described above. The set of phase measurements may be made under controlled conditions, for example, during fabrication of phased array antenna 202 ("at the factory") in order to ensure accurate positioning of nominal position 224.

A gold standard antenna element phase for each array element may also be calculated by accurate modeling of the calibration probe 210 and the phased array antenna 202, as apparent to one of ordinary skill in the art, even though greater accuracy may be expected from direct measurement. For example, modeling calibration probe 210 and phased array antenna 202 may include writing a set of equations for the gold standard antenna element phases using parameters that reflect the specific design characteristics of calibration probe 210 and phased array antenna 202—such as frequency of operation, separation distance of calibration probe 210 and phased array antenna 202, the location of nominal position 224 relative to phased array antenna 202, the location, dimensions and number of elements of phased array antenna 202, and the array gold standard element excitation, for example, and solving the equations for the gold standard antenna element phases using appropriate techniques.

For example, the following equation may be used:

$$\text{phase_=phase_probe}\mathbf{1}+\text{phase_element_}\mathbf{1}+\text{phase_ex}/\mathbf{1}-2\pi R/\lambda$$

where phase_1 is the gold standard phase measured for element 1, phase_probe 1 is the phase of the probe pattern in the direction of element 1, phase_element_1 is the phase of the element in the direction of the calibration probe, phase_exi 1 is the gold standard phase excitation of element 1, R is the distance between the phase center of the probe and array element 1, and λ is the wavelength corresponding to the frequency of operation.

The elements of phased array antenna 202 may be ordered. For example, array element 244 may be "first", array element 248 may be "second", and so forth, and the gold standard antenna element phases for each array element may be placed in the same order so that the gold standard antenna element phases form a vector, denoted Gp.

Method 300 may continue with step 304, in which a set of element phase sensitivities is determined. An element phase sensitivity may be determined for each antenna element of phased array antenna 202, i.e., for all elements of the array, or for only some subset of elements of the array, i.e., for some of the antenna elements of phased array antenna 202 but not all of them. In case a subset would be used, it should be the same subset as would be used to create the gold standard.

For example, element phase sensitivities may be determined by using the calibration system to make a baseline antenna element phase measurement for each array element—such as array element 244 using calibration probe 210 and measurement beam 212—as described above, with calibration probe 210 at nominal position 224. At least one further antenna element phase measurement may be made for the same array element with calibration probe 210 displaced by a known amount and direction to a displaced position 226. A Δx element phase sensitivity may be determined for array element 244, for example, by making a first, baseline antenna element phase measurement, 30 degrees for example, displacing calibration probe 210 0.1 inch along X-axis 216 and making a second, displaced antenna element phase measurement, −15 degrees for example, subtracting the first phase from the second and dividing by the amount of displacement, giving −450 degrees per inch Δx-sensitivity for example.

An rx element phase sensitivity may be determined for array element 244, for example, by making a baseline phase measurement, 30 degrees for example, which need not be repeated except for the sake of example, rotating calibration probe 210 0.1 degree about X-axis 216 and making a second phase measurement, 60 degrees for example, subtracting the first phase from the second and dividing by the known angle of rotation, giving 300 degrees per degree rx-sensitivity for example. Thus, each array element provides a set of 5 element phase sensitivities: a Δx_sensitivity, Δy_sensitivity, Δz_sensitivity, rx_sensitivity, and ry_sensitivity. The set of 5 element phase sensitivities for each array element may be formed into a row vector for each array element, corresponding to the array displacement vector x=(Δx, Δy, Δz, rx, ry), as (Δx_sensitivity, Δy_sensitivity, Δz_sensitivity, rx_sensitivity, ry_sensitivity). The set of element phase sensitivities may be measured under controlled conditions, for example, during fabrication of phased array antenna 202 ("at the factory") in order to ensure accurate positioning of nominal position 224 and displaced positions 226.

A set of element phase sensitivities for each array element also may be calculated by accurate modeling of the calibration probe 210 and the phased array antenna 202, as apparent to one of ordinary skill in the art. Greater accuracy may be expected, however, from direct measurement. Modeling, for example, of calibration probe 210 and phased array antenna 202 may include writing a set of equations for the element phase sensitivities using parameters that reflect the specific design characteristics of calibration probe 210 and phased array antenna 202—such as frequency of operation, separation distance of calibration probe 210 and phased array antenna 202, the location of nominal position 224 relative to phased array antenna 202, and the location, dimensions and number of elements of phased array antenna 202, for example, and solving the equations for the element phase sensitivities using appropriate techniques.

The elements of phased array antenna 202 may be ordered as described above, and the row vectors of element phase sensitivities for each array element may be placed in the same order so that the row vectors of element phase sensitivities form a matrix, denoted A, which is compatible for purposes of matrix multiplication with the array displacement vector x and the gold standard vector Gp described above.

Method 300 may continue with step 306, in which a set of antenna element phases relative to a displaced position of calibration probe 210 is measured with calibration probe 210 at a displaced position 226 relative to phased array antenna 202. Such a set of antenna element phases may also be referred to as a set of antenna element phases relative to array displacement. An antenna element phase relative to array displacement may be determined for each antenna element of phased array antenna 202, i.e., for all elements of the array, or for only some subset of elements of the array, i.e., for some of the antenna elements of phased array antenna 202 but not all of them. In case a subset would be used, it should be the same subset as would be used to create the gold standard.

A set of antenna element phases relative to array displacement may be measured at any time subsequent to creation of the gold standard and determination of element phase sensitivities. For example, a set of antenna element phases relative to array displacement may be measured while spacecraft 100 is in orbit using the calibration system to make a phase measurement for each array element—such as array element 244—using calibration probe 210, and measurement beam 212—as described above. The elements of phased array antenna 202 may be ordered as described above, and the set of antenna element phases relative to array displacement for each array element may be placed in the same order so that the antenna element phases relative to array displacement form a vector, denoted Ep, which is compatible for purposes of matrix multiplication with the matrix A, the array displacement vector x, and the gold standard vector Gp, described above.

Method 300 may continue with step 308, in which a set of linear equations may be formed. An equation may be formed for each element of phased array antenna 202 for which a gold standard antenna element phase, a set of element phase sensitivities, and an antenna element phase relative to array displacement has been determined. For example, if Gp1 is a gold standard antenna element phase for array element 244, and if Δx_sensitivity1 , Δy_sensitivity1 , Δz_sensitivity1 , rx_sensitivity1 , ry_sensitivity1 is a set of element phase sensitivities for array element 244, and if Ep1 is an antenna element phase relative to array displacement for array element 244 and the unknown displacement of calibration probe 210 from nominal position 224 to displaced position 226 is represented by the array displacement vector x=(Δx, Δy, Δz, rx, ry), then the following equation for array element 244 may be formed:

$$(\Delta x_\text{sensitivity}\mathbf{1}\cdot\Delta x)+(\Delta y_\text{sensitivity}\mathbf{1}\cdot\Delta y)+(\Delta z_\text{sensitivity}\mathbf{1}\cdot\Delta z)+(rx_\text{sensitivity}\mathbf{1}\cdot rx)+(ry_\text{sensitivity}\mathbf{1}\cdot ry)=(\text{Ep}\mathbf{1}-\text{Gp}\mathbf{1}) \quad (1)$$

If the elements of phased array antenna 202 are ordered as described above, and the set of equations—such as equation (1)—for each array element are placed in the same order, the set of equations for finding array displacement vector x may be written, using the above definitions of A, Ep, and Gp, in matrix notation as:

$$Ax=(Ep-Gp) \quad (2)$$

where matrix A may have as many rows as phased array antenna 202 has elements, for example. Also for example, if a subset of the elements of phased array antenna 202 has been used as described above, then A may have as many rows as the subset has array elements.

Method 300 may continue with step 310, in which a set of linear equations—such as equation (1)—for each array element of phased array antenna 202, or for a subset of array elements of phased array antenna 202, may be solved for array displacement vector x=(Δx, Δy, Δz, rx, ry). As known in the art, a unique solution for array displacement vector x may be found if there are at least 5 independent equations such as equation (1) since array displacement vector x has 5 components. Equivalently, matrix equation (2) may be solved for array displacement vector x if matrix A has at least 5 independent rows. A number of techniques are known for solving linear equations such as equation (1) or equation (2) including Gaussian elimination for example. Moreover, phased array antennas—such as phased array antenna 202—typically have a large number of elements so that matrix A may have more than 5 rows, i.e., may be "over specified" as known in the art, so that a number of well-known regression, or "best fit" statistical techniques may be applied. In practice, least squares pseudo-inverse solutions may be desirable because they diminish the destabilizing effects of measurement errors in determining A, Gp, and Ep and ensure that the closest solution for array displacement vector x may be found. Examples of well-known least squares regression techniques include, for example, Moore-Penrose technique, Gaussian elimination, and single-value decomposition. Such techniques for solving equation (2) may be implemented, for example, using a computer, which may be located, for example, on the ground and which may communicate with a spacecraft—such as spacecraft 100, for example, via telemetry. Such a technique for solving equation (2) also may be implemented, for example, using a computer or processor, which may be located, for example, on the spacecraft itself—such as spacecraft 100, for example, It should be understood, of course, that the foregoing relates to preferred embodiments of the invention and that modifications may be made without departing from the spirit and scope of the invention as set forth in the following claims.

We claim:

1. A method for detecting calibration probe displacement for a phased array antenna, comprising steps of:

creating a gold standard set of antenna element phases of said phased array antenna;

determining a set of element phase sensitivities of said phased array antenna;

measuring a set of antenna element phases relative to array displacement of said phased array antenna;

forming a set of equations using said gold standard set of antenna element phases, said set of element phase sensitivities, and said set of antenna element phases relative to array displacement, said set of equations having an array displacement vector x as unknown; and solving said set of equations for said array displacement vector x.

2. The method of claim 1 wherein said step of creating said gold standard set of antenna element phases includes measuring a gold standard antenna element phase of an array element with a calibration probe at a nominal position.

3. The method of claim 1 wherein said step of creating said gold standard set of antenna element phases includes calculating said gold standard set of antenna element phases.

4. The method of claim 1 wherein said step of determining said set of element phase sensitivities includes:

measuring a baseline antenna element phase for an array element with a calibration probe at a nominal position;

displacing said calibration probe a known amount and direction to a displaced position;

measuring a displaced antenna element phase for said array element with said calibration probe at said displaced position.

5. The method of claim 1 wherein said step of determining said set of element phase sensitivities includes calculating said set of element phase sensitivities.

6. The method of claim 1 wherein said step of determining said set of element phase sensitivities comprises subtracting a baseline antenna element phase measurement from a displaced antenna element phase measurement and dividing by an amount of displacement.

7. The method of claim 1 wherein said step of determining said set of element phase sensitivities includes:

measuring a baseline antenna element phase for an array element with a calibration probe at a nominal position;

rotating said calibration probe a known angle and direction to a displaced position;

measuring a displaced antenna element phase for said array element with said calibration probe at said displaced position.

8. The method of claim 1 wherein said step of determining said set of element phase sensitivities comprises subtracting a baseline antenna element phase measurement from a displaced antenna element phase measurement and dividing by an angle of rotation.

9. The method of claim 1 wherein said step of measuring said set of antenna element phases relative to array displacement includes measuring an antenna element phase of an array element with a calibration probe at a displaced position.

10. The method of claim 1 wherein said step of determining said set of element phase sensitivities is performed for at least 5 array elements of said phased array antenna.

11. The method of claim 1 wherein said step of forming said set of equations includes forming an equation:

$$(\Delta x_\text{sensitivity}\mathbf{1}\cdot\Delta x)+(\Delta y_\text{sensitivity}\mathbf{1}\cdot\Delta y)+(\Delta z_\text{sensitivity}\mathbf{1}\cdot\Delta z)+(rx_\text{sensitivity}\mathbf{1}\cdot rx)+(ry_\text{sensitivity}\mathbf{1}\cdot ry)=(\text{Ep}\mathbf{1}-\text{Gp}\mathbf{1}).$$

12. The method of claim 1 wherein said step of forming said set of equations includes writing said set of equations in matrix notation.

13. The method of claim 1 wherein said step of solving said set of equations is performed using a least squares regression technique.

14. A method for detecting displacement of a calibration probe relative to a phased array antenna, comprising steps of:

creating a gold standard set of antenna element phases including creating a gold standard antenna element phase of an array element of said phased array antenna with a calibration probe at a nominal position;

determining a set of element phase sensitivities of said phased array antenna, including:

determining a baseline antenna element phase for said array element with a calibration probe at said nominal position;

determining a displaced antenna element phase for said array element with said calibration probe at a first displaced position that differs from said nominal position by a known amount;

measuring a set of antenna element phases relative to array displacement including measuring an antenna element phase relative to array displacement of said array element of said phased array antenna with said calibration probe at a second displaced position;

forming a set of equations using said gold standard set of antenna element phases, said set of element phase sensitivities, and said set of antenna element phases relative to array displacement, said set of equations having an array displacement vector x as unknown; and solving said set of equations for said array displacement vector x.

15. The method of claim 14 wherein said step of creating said gold standard set of antenna element phases includes using a calibration system to measure said gold standard antenna element phase of said array element.

16. The method of claim 14 wherein said step of creating said gold standard set of antenna element phases includes calculating said gold standard set of antenna element phases by modeling the calibration probe and the phased array antenna, said modeling including:

writing a set of equations for said gold standard set of antenna element phases; and solving said set of equations for said gold standard set of antenna element phases.

17. The method of claim 14 wherein said step of determining said set of element phase sensitivities includes using a calibration system to measure said set of element phase sensitivities of said array element.

18. The method of claim 14 wherein said step of determining said set of element phase sensitivities includes calculating said set of element phase sensitivities by modeling the calibration probe and the phased array antenna, said modeling including:

writing a set of equations for said set of element phase sensitivities; and solving said set of equations for said set of element phase sensitivities.

19. The method of claim 14 wherein said step of determining said set of element phase sensitivities includes subtracting said baseline antenna element phase from said displaced antenna element phase and dividing by said known amount.

20. The method of claim 14 wherein said step of determining a set of element phase sensitivities includes:

rotating said calibration probe a known angle and direction to a second displaced position;

measuring a second displaced antenna element phase for said array element with said calibration probe at said second displaced position;

subtracting said baseline antenna element phase from said second displaced antenna element phase and dividing by said known angle.

21. The method of claim 14 wherein said step of measuring said set of antenna element phases relative to array displacement includes using a calibration system to measure said antenna element phase relative to array displacement.

22. The method of claim 14 wherein said step of determining a set of element phase sensitivities includes determining a row vector (Δx_sensitivity, Δy_sensitivity, Δz_sensitivity, rx_sensitivity, ry_sensitivity) of element phase sensitivities.

23. The method of claim 14 wherein said step of forming said set of equations includes forming an equation with unknowns Δx, Δy, Δz, rx, and ry for said array element as:

$$(\Delta x_\text{sensitivity}\mathbf{1}\cdot\Delta x)+(\Delta y_\text{sensitivity}\mathbf{1}\cdot\Delta y)+(\Delta z_\text{sensitivity}\mathbf{1}\cdot\Delta z)+(rx_\text{sensitivity}\mathbf{1}\cdot rx)+(ry_\text{sensitivity}\mathbf{1}\cdot ry)=(\text{Ep}\mathbf{1}-\text{Gp}\mathbf{1}).$$

24. The method of claim 14 wherein said step of forming said set of equations includes ordering said set of equations and writing said set of equations in matrix notation as:

$$Ax=(Ep-Gp).$$

25. The method of claim 14 wherein said step of solving said set of equations is performed using a least squares regression technique including Gaussian elimination.

26. A method for in-flight detection of relative displacement between a calibration probe on-board a spacecraft and a phased array antenna on-board the spacecraft, comprising steps of:

creating a gold standard set of antenna element phases including measuring a gold standard antenna element phase of an array element of said phased array antenna with a calibration probe at a nominal position under controlled conditions;

determining a set of element phase sensitivities of said phased array antenna under controlled conditions, including:

measuring a baseline antenna element phase for said array element with a calibration probe at said nominal position;

displacing said calibration probe a known amount and direction to a first displaced position;

measuring a first displaced antenna element phase for said array element with said calibration probe at said first displaced position;

subtracting said baseline antenna element phase from said first displaced antenna element phase and dividing by said known amount;

rotating said calibration probe a known angle and direction to a second displaced position;

measuring a second displaced antenna element phase for said array element with said calibration probe at said second displaced position;

subtracting said baseline antenna element phase from said second displaced antenna element phase and dividing by said known angle;

measuring a set of antenna element phases relative to array displacement by using a calibration system while said spacecraft is in flight including measuring an antenna element phase relative to array displacement of said array element of said phased array antenna with said calibration probe at a third displaced position;

forming a set of equations using said gold standard set of antenna element phases, said set of element phase sensitivities, and said set of antenna element phases relative to array displacement, said set of equations having an array displacement vector x as unknown, wherein said array displacement vector x determines a location and orientation of said third displaced position; and solving said set of equations for said array displacement vector x.

27. The method of claim 26 wherein said step of creating said gold standard set of antenna element phases includes using a second calibration system to measure said gold standard antenna element phase of said array element under controlled conditions.

28. The method of claim 26 wherein said step of determining said set of element phase sensitivities includes using a second calibration system to measure said set of element phase sensitivities of said array element under controlled conditions.

29. The method of claim 26 wherein said step of determining a set of element phase sensitivities includes determining, for said array element, a Δx_sensitivity1 , a Δy_sensitivity1 , a Δz_sensitivity1 , an rx_sensitivity1 , and an ry_sensitivity1 .

30. The method of claim 29 wherein said step of forming said set of equations includes forming an equation with unknowns Δx, Δy, Δz, rx, and ry for said array element as:

$$(\Delta x_\text{sensitivity}\mathbf{1}\cdot\Delta x)+(\Delta y_\text{sensitivity}\mathbf{1}\cdot\Delta y)+(\Delta z_\text{sensitivity}\mathbf{1}\cdot\Delta z)+(rx_\text{sensitivity}\mathbf{1}\cdot rx)+(ry_\text{sensitivity}\mathbf{1}\cdot ry)=(Ep\mathbf{1}-Gp\mathbf{1}).$$

31. The method of claim 26 wherein said step of forming said set of equations includes ordering said set of equations and writing said set of equations in matrix notation as:

$$Ax=(Ep-Gp).$$

32. The method of claim 26 wherein said step of solving said set of equations is performed using Gaussian elimination.

33. A method for in-flight detection of relative displacement between a calibration probe on-board a spacecraft and a phased array antenna on-board the spacecraft, comprising steps of:

creating a gold standard set of antenna element phases including measuring a gold standard antenna element phase Gp1 of an array element of said phased array antenna with a calibration probe at a nominal position under controlled conditions;

determining under controlled conditions a set of element phase sensitivities for said array element, including a Δx_sensitivity1 , a Δy_sensitivity1 , a Δz_sensitivity1 , an rx_sensitivity1 , and an ry_sensitivity1 , including:

measuring a baseline antenna element phase for said array element with a calibration probe at said nominal position;

displacing said calibration probe a known amount and direction to a first displaced position;

measuring a first displaced antenna element phase for said array element with said calibration probe at said first displaced position;

subtracting said baseline antenna element phase from said first displaced antenna element phase and dividing by said known amount;

rotating said calibration probe a known angle and direction to a second displaced position;

measuring a second displaced antenna element phase for said array element with said calibration probe at said second displaced position;

subtracting said baseline antenna element phase from said second displaced antenna element phase and dividing by said known angle;

measuring a set of antenna element phases relative to array displacement by using a calibration system while said spacecraft is in flight including measuring an antenna element phase Ep1 relative to array displacement of said array element of said phased array antenna with said calibration probe at a third displaced position;

forming a set of equations using said gold standard set of antenna element phases, said set of element phase sensitivities, and said set of antenna element phases relative to array displacement, said set of equations having an array displacement vector x=(Δx, Δy, Δz, rx, ry) as unknown, wherein said array displacement vector x determines a location and orientation of said third displaced position, said set of equations including the equation:

$$(\Delta x_\text{sensitivity}\mathbf{1}\cdot\Delta x)+(\Delta y_\text{sensitivity}\mathbf{1}\cdot\Delta y)+(\Delta z_\text{sensitivity}\mathbf{1}\cdot\Delta z)+(rx_\text{sensitivity}\mathbf{1}\cdot rx)+(ry_\text{sensitivity}\mathbf{1}\cdot ry)=(\text{Ep}\mathbf{1}-\text{Gp}\mathbf{1});$$

ordering said set of equations and writing said set of equations in matrix notation as:

$$Ax=(Ep-Gp);\text{ and}$$

solving said set of equations for said array displacement vector x.

34. The method of claim 33 wherein said step of solving said set of equations is performed using a regression technique.

35. A method for in-flight detection of relative displacement between a calibration probe on-board a spacecraft and a phased array antenna on-board the spacecraft, comprising steps of:

creating a gold standard set of antenna element phases including calculating a gold standard antenna element phase of an array element of said phased array antenna for a calibration probe at a nominal position;

determining a set of element phase sensitivities of said phased array antenna, including:

calculating a baseline antenna element phase for said array element for a calibration probe at said nominal position;

calculating a first displaced antenna element phase for said array element for said calibration probe at a first displaced position that differs from said nominal position by a known amount;

subtracting said baseline antenna element phase from said first displaced antenna element phase and dividing by said known amount;

calculating a second displaced antenna element phase for said array element for said calibration probe at a second displaced position that is rotated from said nominal position by a known angle;

subtracting said baseline antenna element phase from said second displaced antenna element phase and dividing by said known angle;

measuring a set of antenna element phases relative to array displacement by using a calibration system while said spacecraft is in flight including measuring an antenna element phase relative to array displacement of said array element of said phased array antenna with said calibration probe at a third displaced position;

forming a set of equations using said gold standard set of antenna element phases, said set of element phase sensitivities, and said set of antenna element phases relative to array displacement, said set of equations having an array displacement vector x as unknown, wherein said array displacement vector x determines a location and orientation of said third displaced position; and solving said set of equations for said array displacement vector x.

36. The method of claim 35 wherein said step of creating said gold standard set of antenna element phases includes calculating said gold standard set of antenna element phases by modeling the calibration probe and the phased array antenna, said modeling including:

writing a set of equations for said gold standard set of antenna element phases; and solving said set of equations for said gold standard set of antenna element phases.

37. The method of claim 35 wherein said step of determining said set of element phase sensitivities includes calculating said set of element phase sensitivities by modeling the calibration probe and the phased array antenna, said modeling including:

writing a set of equations for said set of element phase sensitivities; and solving said set of equations for said set of element phase sensitivities.

38. The method of claim 35 wherein said step of determining a set of element phase sensitivities includes determining, for said array element, a Δx-sensitivity1 , a Δy_sensitivity1 , a Δz_sensitivity1 , an $rx_{13}$ sensitivity1 , and an ry_sensitivity1 .

39. The method of claim 38 wherein said step of forming said set of equations includes forming an equation with unknowns Δx, Δy, Δz, rx, and ry for said array element as:

$$(\Delta x_\text{sensitivity}\mathbf{1}\cdot\Delta x)+(\Delta y_\text{sensitivity}\mathbf{1}\cdot\Delta y)+(\Delta z_\text{sensitivity}\mathbf{1}\cdot\Delta z)+(rx_\text{sensitivity}\mathbf{1}\cdot rx)+(ry_\text{sensitivity}\mathbf{1}\cdot ry)=(\text{Ep}\mathbf{1}-\text{Gp}\mathbf{1}).$$

40. The method of claim 35 wherein said step of forming said set of equations includes ordering said set of equations and writing said set of equations in matrix notation as:

$$Ax=(Ep-Gp).$$

41. The method of claim 35 wherein said step of solving said set of equations is performed using Gaussian elimination.

42. A method for in-flight detection of relative displacement between a calibration probe on-board a spacecraft and a phased array antenna on-board the spacecraft, comprising steps of:

creating a gold standard set of antenna element phases including calculating a gold standard antenna element phase Gp1 of an array element of said phased array antenna for a calibration probe at a nominal position, and including modeling the calibration probe and the phased array antenna by writing and solving a set of equations for said gold standard set of antenna element phases;

determining a set of element phase sensitivities, for said array element, said set of element phase sensitivities including a Δx_sensitivity1 , a Δy_sensitivity1 , a Δz_sensitivity1 , an rx_sensitivity1 , and an ry_sensitivity1 , wherein the calibration probe and the phased array antenna are modeled by writing and solving a set of equations for said set of element phase sensitivities, including:

calculating a baseline antenna element phase for said array element for a calibration probe at said nominal position;

calculating a first displaced antenna element phase for said array element for said calibration probe at a first displaced position that differs from said nominal position by a known amount;

subtracting said baseline antenna element phase from said first displaced antenna element phase and dividing by said known amount;

calculating a second displaced antenna element phase for said array element for said calibration probe at a second displaced position that is rotated from said nominal position by a known angle;

subtracting said baseline antenna element phase from said second displaced antenna element phase and dividing by said known angle;

measuring a set of antenna element phases relative to array displacement by using a calibration system while said spacecraft is in flight including measuring an antenna element phase Ep1 relative to array displacement of said array element of said phased array antenna with said calibration probe at a third displaced position;

forming a set of equations using said gold standard set of antenna element phases, said set of element phase sensitivities, and said set of antenna element phases relative to array displacement, said set of equations having an array displacement vector x=(Δx, Δy, Δz, rx, ry) as unknown, wherein said array displacement vector x determines a location and orientation of said third displaced position, said set of equations including the equation:

$$(\Delta x_\text{sensitivity}\mathbf{1}\cdot\Delta x)+(\Delta y_\text{sensitivity}\mathbf{1}\cdot\Delta y)+(\Delta z_\text{sensitivity}\mathbf{1}\cdot\Delta z)+(rx_\text{sensitivity}\mathbf{1}\cdot rx)+(ry_\text{sensitivity}\mathbf{1}\cdot ry)=(\text{Ep}\mathbf{1}-\text{Gp}\mathbf{1});$$

ordering said set of equations and writing said set of equations in matrix notation as:

$$Ax=(Ep-Gp);\text{ and}$$

solving said set of equations for said array displacement vector x.

43. The method of claim 42 wherein said step of solving said set of equations is performed using a regression technique.

* * * * *